US008093524B2

(12) United States Patent
Previeux et al.

(10) Patent No.: US 8,093,524 B2
(45) Date of Patent: Jan. 10, 2012

(54) ELECTRICAL SWITCHGEAR UNIT SUCH AS A CIRCUIT BREAKER OR SWITCH

(75) Inventors: Laurent Previeux, Grenoble (FR); Yves Brune, Merlas (FR); Claude Burnot, Echirolles (FR); Roland Masnada, Eybens (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 559 days.

(21) Appl. No.: 12/289,902

(22) Filed: Nov. 6, 2008

(65) Prior Publication Data

US 2009/0127085 A1 May 21, 2009

(30) Foreign Application Priority Data

Nov. 16, 2007 (FR) ..... 07 08042

(51) Int. Cl.
*H01H 5/00* (2006.01)

(52) U.S. Cl. ..... 200/400

(58) Field of Classification Search ..... 200/400, 200/401, 244, 239, 250; 335/16, 188, 191, 335/36–37
See application file for complete search history.

(56) References Cited

U.S. PATENT DOCUMENTS

| | | | | |
|---|---|---|---|---|
| 7,750,259 | B2 * | 7/2010 | Besana et al. | 200/244 |
| 2008/0185280 | A1 * | 8/2008 | Bresciani et al. | 200/400 |
| 2008/0257702 | A1 * | 10/2008 | Weister et al. | 200/400 |

FOREIGN PATENT DOCUMENTS

| | | |
|---|---|---|
| AT | 414 318 | 2/2007 |
| FR | 2 717 617 | 9/1995 |
| WO | 2005/069335 | 7/2005 |

* cited by examiner

*Primary Examiner* — Edwin A. Leon
(74) *Attorney, Agent, or Firm* — Steptoe & Johnson LLP

(57) ABSTRACT

The present invention is an electrical switchgear unit in a case and including at least one stationary contact and at least one movable contact supported by a contact support shaft, an opening and/or closing mechanism of the movable contact(s) fitted in a support, the mechanism including a manual operating handle of the contact(s) rotatable around a toggle pin of the case, and a high-speed closing shaft designed to keep the movable contact(s) in the open position, at the beginning of manual closing of the handle and over a certain travel, by storing energy and to release the movable contact(s) after travel of the handle so that the stored energy causes high-speed closing of the contacts. On one of its side faces, the device includes the support of the mechanism which includes an opening to accommodate at least a part of the high-speed closing shaft, which is inserted laterally at least partially into the support prior to fixing of the shaft inside the case, and the means for fixing said support inside the case is located on one side of the mechanism.

8 Claims, 7 Drawing Sheets

ELECTRICAL SWITCHGEAR UNIT SUCH AS A CIRCUIT BREAKER OR SWITCH

The present invention relates to an electrical switchgear unit such as a switch, the unit being housed in a case and including at least one stationary contact and at least one movable contact, the movable contact(s) being supported by a contact support shaft, the shaft being mounted rotatably between an open position of the contact(s) and a closed position of the contacts, an opening and/or closing mechanism of the contact(s) fitted in a support, the mechanism including a manual operating handle of the contact(s) fitted rotatably around a toggle pin of the case, a high-speed closing shaft for keeping the movable contact(s) in the open position, at the beginning of a manual closing operation of the handle and over a certain travel of the latter, by storing energy and to release the movable contact(s) after this travel of the handle so that the stored energy causes high-speed closing of the contacts, and means for fixing the mechanism inside the case.

An electrical switchgear unit such as the one described in Patent FR 2717617 is known. In this unit, the mechanism is fitted above the high-speed closing shaft and the high-speed closing shaft return spring is fitted between the high-speed closing shaft and the mechanism. This results, once the mechanism has been fitted, in the high-speed closing shaft no longer being able to be removed without removing the mechanism. The choice of fitting the shaft or not always has to be made before the mechanism is fitted. Differentiation can therefore not be put off as long as possible on the manufacturing line with this high-speed closing function.

The present invention provides a solution to these drawbacks and proposes an electrical switchgear unit of simple design wherein differentiation with the high-speed closing function can be put off as long as possible on the manufacturing line, just before the case is closed.

For this purpose, the object of the present invention is to provide an electrical switchgear unit such as a switch, this unit being characterized in that, on one of its side faces, the support of the above-mentioned mechanism includes an opening designed to accommodate at least a part of the high-speed closing shaft, the latter thereby being able to be inserted laterally at least partially into the support when the latter is fitted inside the case, and that the means for fixing the mechanism inside the case is located on one side of the mechanism only with respect to the high-speed closing shaft.

According to a particular feature of the invention, this unit includes a breaking module having at least one arc chute and the above-mentioned mechanism is fixed onto the breaking module.

According to another feature of the invention, the above-mentioned breaking module is a removable monoblock module.

Advantageously, this high-speed closing shaft is mounted rotating with respect to the breaking module.

According to another feature, these means for fixing the mechanism on the breaking module are clipping or clipsing means.

According to another feature, these means for fixing the mechanism on said breaking module include at least one lug belonging to the support of the mechanism operating with sliding in conjunction respectively with at least one slide belonging to the above-mentioned breaking module.

According to another feature, this unit includes a spring designed to bias the high-speed closing shaft towards the movable contact(s), said spring being fitted between said breaking module and the high-speed closing shaft.

According to a particular embodiment of the invention, this unit is one of the units included in the group comprising a switch, a controlled switch, a disconnecting switch, a circuit breaker, a differential switch and a differential circuit breaker.

But other advantages and features of the invention will become more clearly apparent from the following description which refers to the appended drawings given for exemplary purposes only.

DETAILED DESCRIPTION

Figure 1:
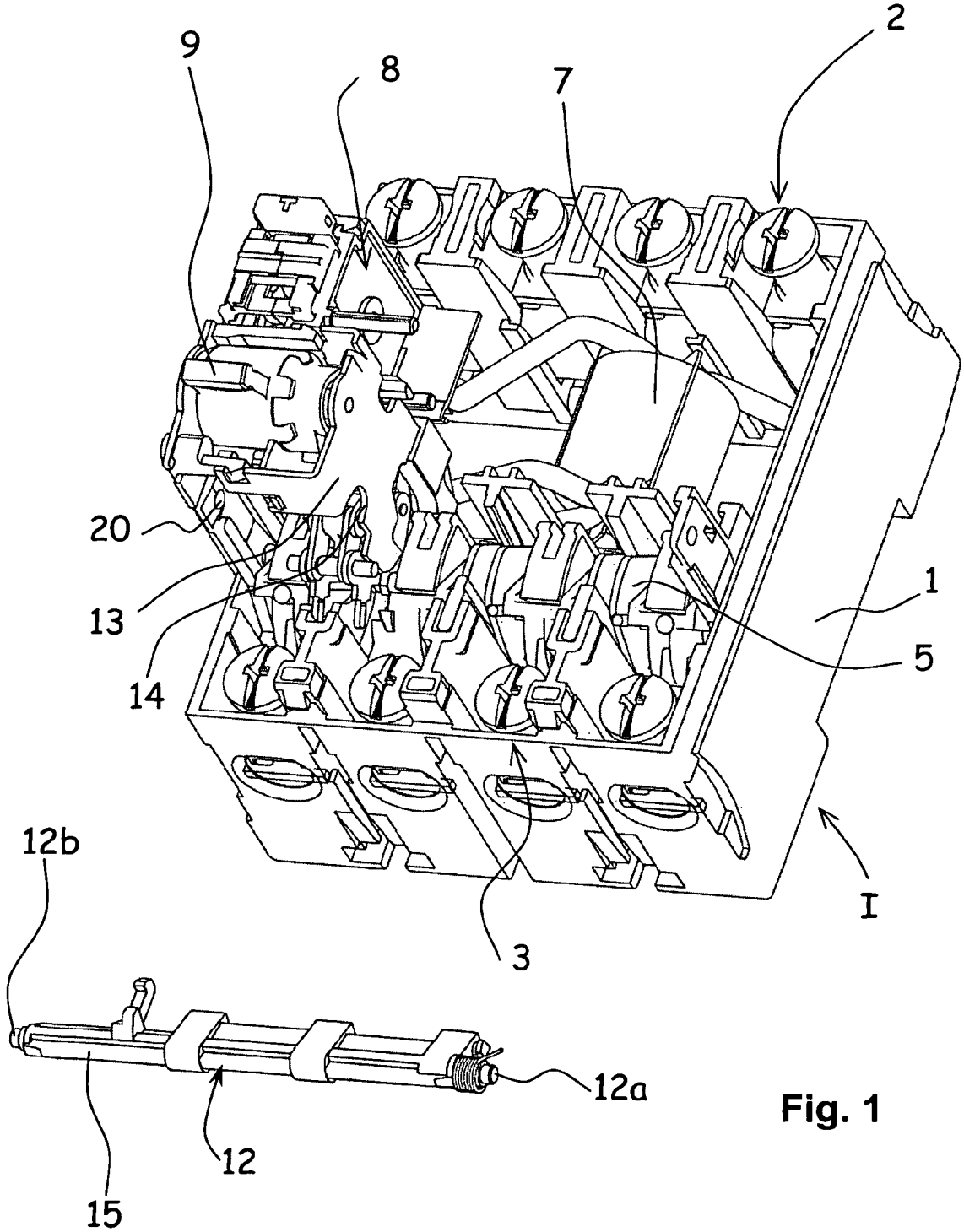
FIG. 1 is a perspective view illustrating an electrical switchgear unit according to the invention, without the cover, before the high-speed closing shaft is fitted therein.

The following are housed inside this case: line-side terminals 2, load-side terminals 3, stationary contacts 4 fixed with respect to the case, a shaft 5 called movable contact support shaft 6 mounted rotating in the unit between a position called open position wherein movable contacts 6 are separated from stationary contacts 4, and a position called closed position wherein movable contacts 6 are in contact respectively with stationary contacts 4. This unit further includes means designed for performing automatic opening of the contacts in the event of a differential fault, these means including differential detection means, i.e. a toroidal core, designed to detect an earth fault. This device also includes an operating mechanism 8 of the movable contact(s), this mechanism 8 including a manual operating handle 9 of the contact support shaft. This mechanism is designed to be fixed onto the unit in the manner that will be described in the following.

Figure 7:
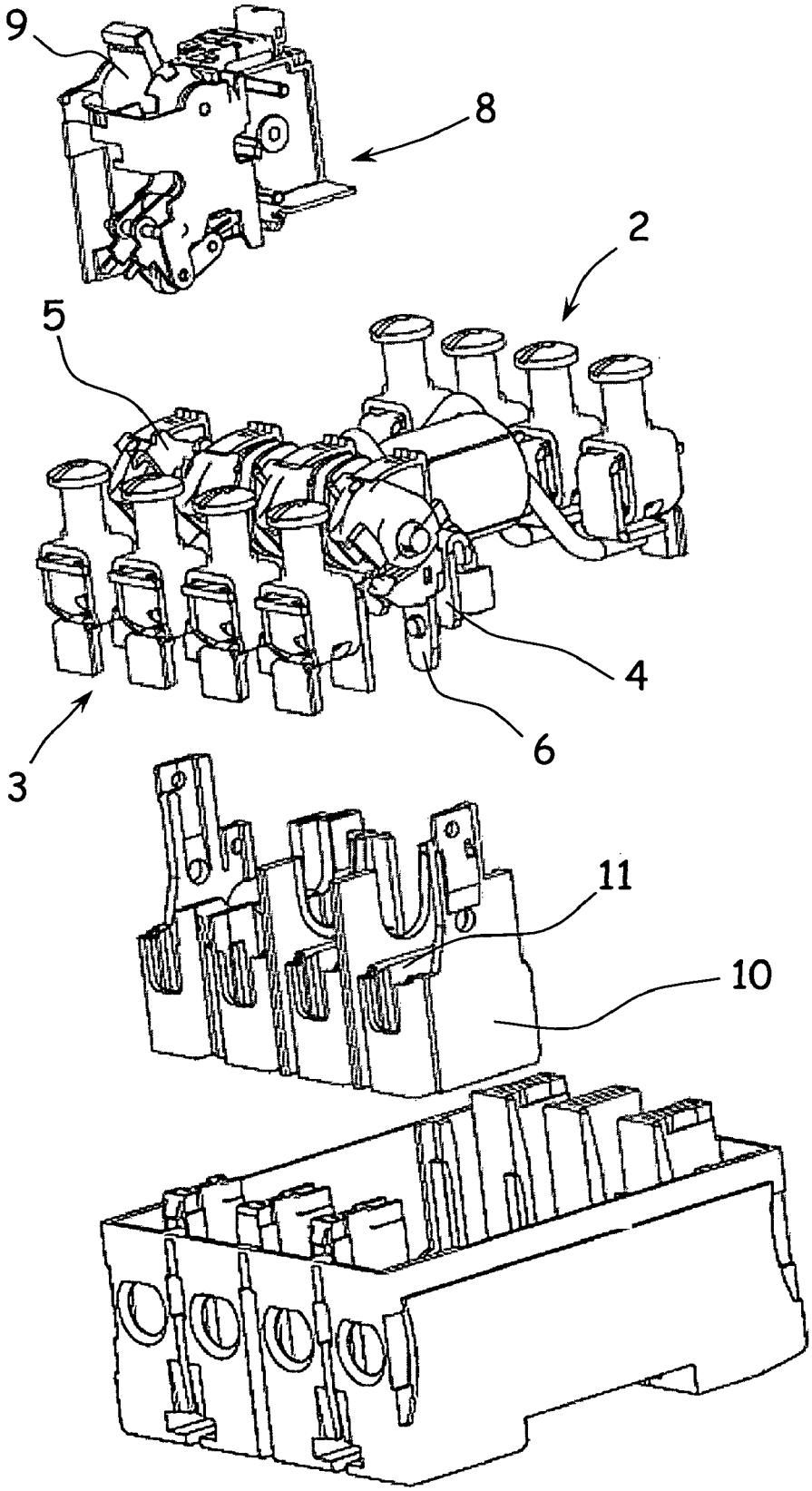
FIG. 7 is an exploded perspective view illustrating the different parts of the unit.

The unit further includes a removable monoblock breaking module 10 (FIG. 7) having four arc chutes 11 in this particular described embodiment and designed to accommodate the stationary and movable contacts of the unit.

This unit also includes in known manner a shaft called high-speed closing shaft 12 designed to keep contact support shaft 5 in the open position of the contacts, at the beginning of the manual closing operation of the handle and over a certain travel of the latter, by storing energy and to release the contact support shaft after this travel of the handle so that the stored energy causes high-speed closing of the contacts.

According to the invention, this contact support shaft operating mechanism 8 is housed in a support 13, this support 13 including a lateral notch 14 designed to receive an end part 15 of high-speed closing shaft 12. Fixing of the mechanism is performed on one side of the unit only with respect to high-speed closing shaft 12. According to the embodiment illustrated in the drawings, this fixing is achieved by means of at least one fixing lug 16 of support 13, the lugs 16 being fitted for sliding in at least one slide 17 of breaking module 10.

This unit also comprises in known manner a shaft called high-speed closing shaft 12 designed to keep contact support shaft 5 in the open position of the contacts, at the beginning of the manual closing operation of the handle and over a certain travel of the latter, by storing energy and to release the contact support shaft after this travel of the handle so that the stored energy causes high-speed closing of the contacts.

According to the invention, this contact support shaft operating mechanism 8 is housed in a support 13, this support 13 comprising a lateral notch 14 designed to receive an end part 15 of high-speed closing shaft 12. Fixing of the mechanism is performed on one side of the unit only with respect to high-speed closing shaft 12. According to the embodiment illustrated in the drawings, this fixing is achieved by means of at least one fixing lug 16 belonging to support 13, said lugs 16 being fitted with sliding respectively in at least one slide 17 belonging to breaking module 10.

Figure 2:
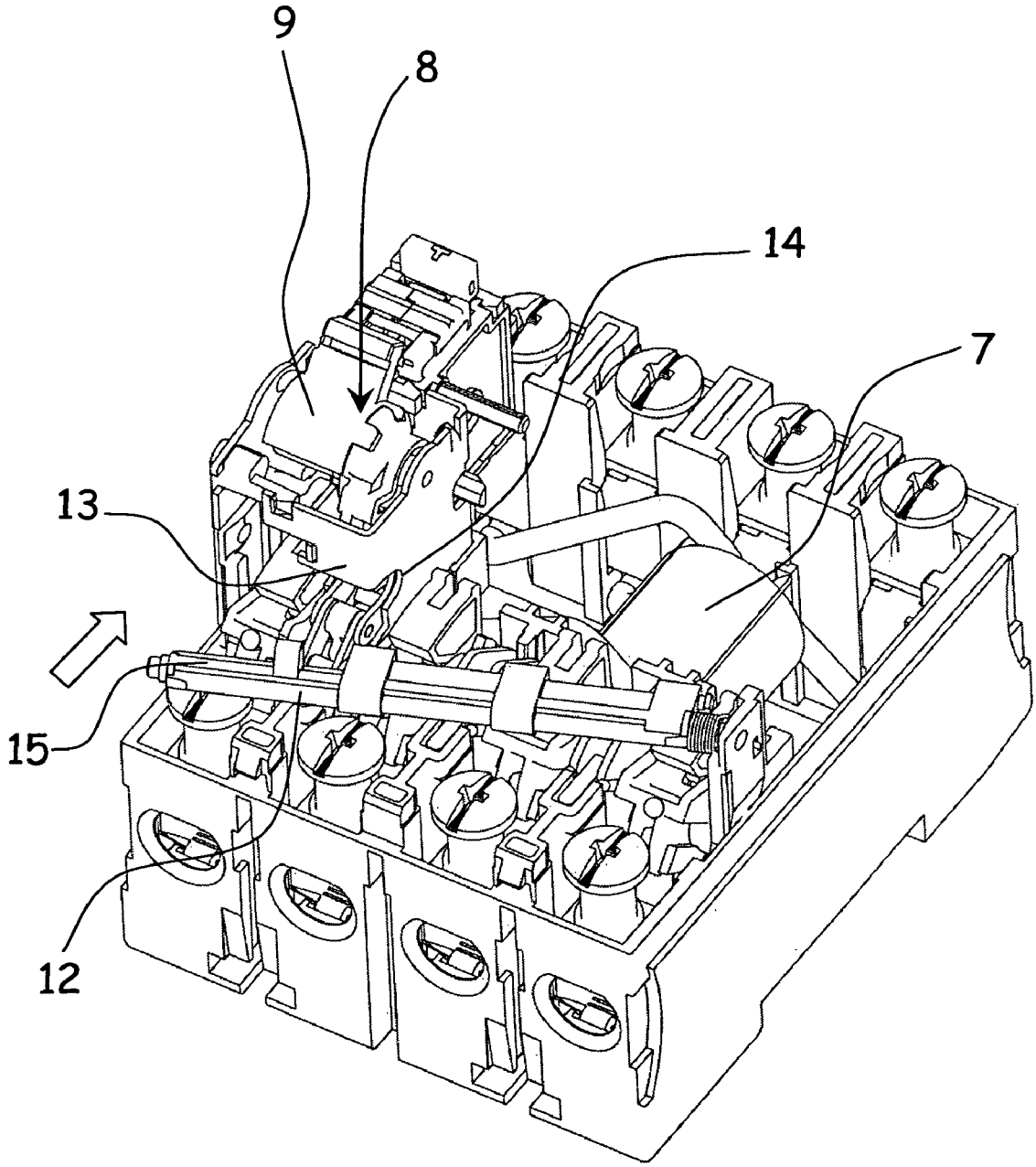
FIG. 2 is a similar perspective view to the previous figure during fitting of the high-speed closing shaft.

This notch 14 enables the high-speed closing shaft to be fitted in the case after the mechanism has been assembled. This fitting of said shaft, as illustrated in FIGS. 1 to 3, consists, after a spring 18 has been fitted at one 12*a* of the ends of high-speed closing shaft 12, as illustrated in FIG. 2, in inserting this end into a hole 19 of the breaking module.

Figure 3:
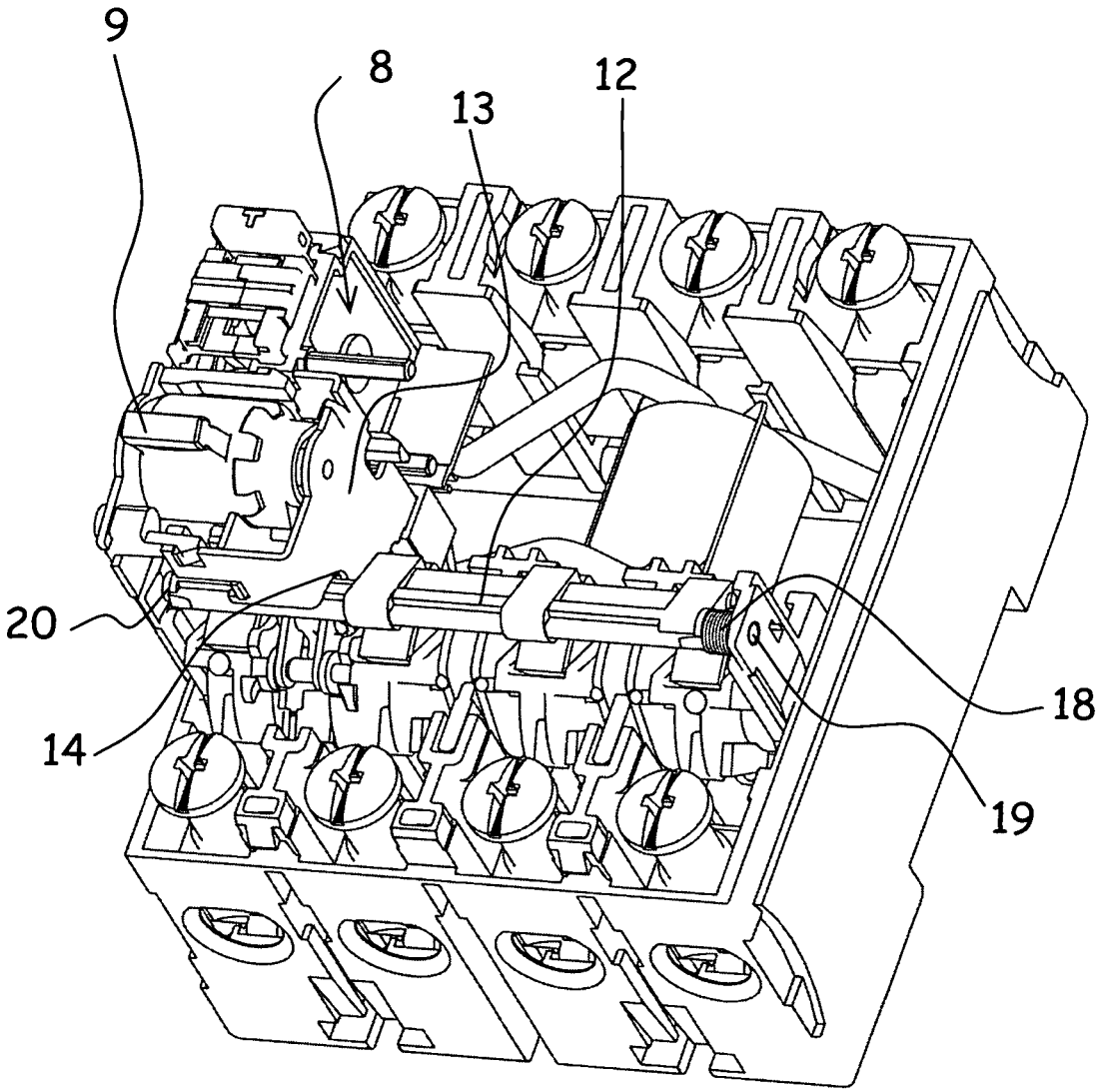
FIG. 3 is a similar perspective view to the previous views, the high-speed closing shaft being in the fitted position in the unit.
Figure 4:
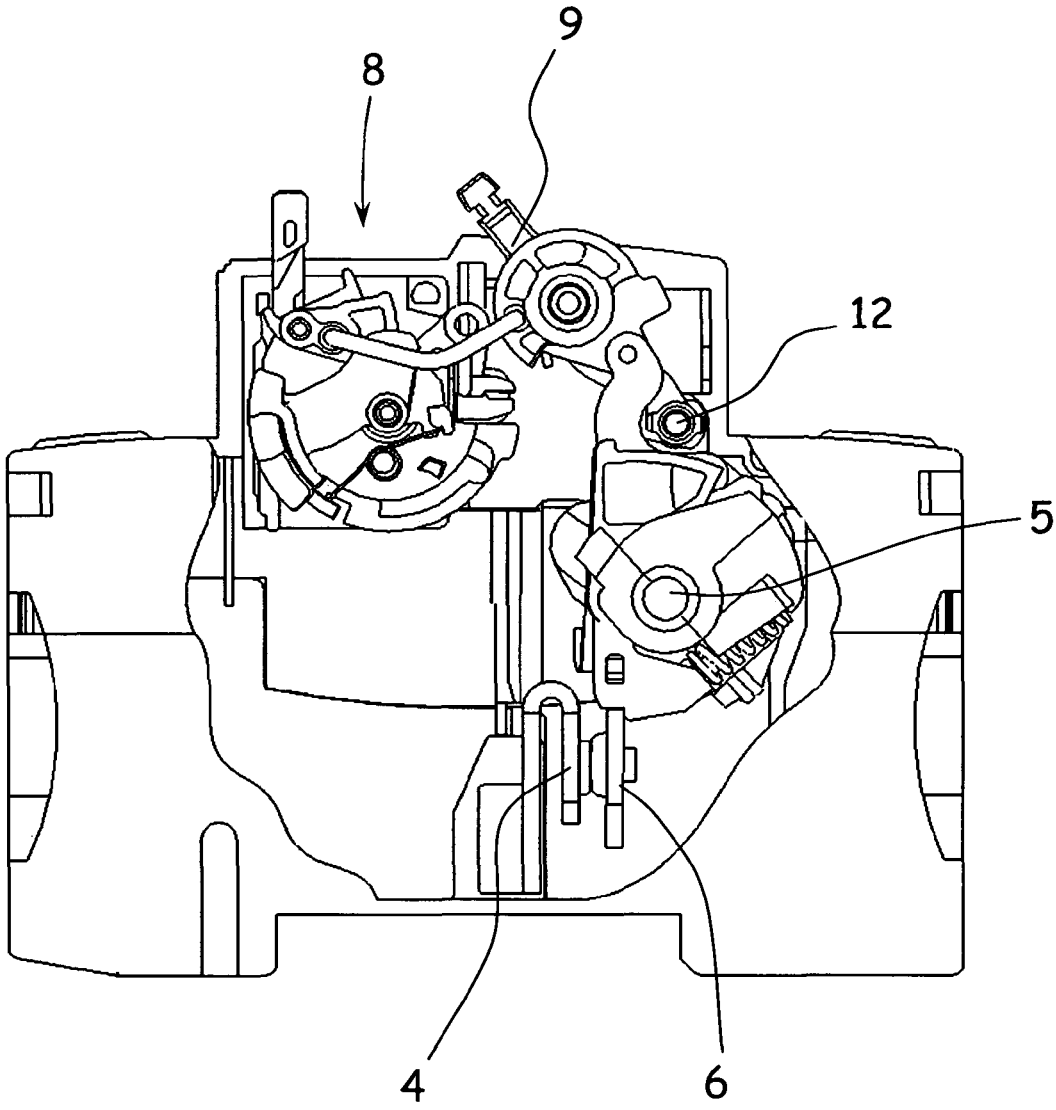
FIG. 4 is a partial cross-section illustrating the inside part of the unit.
Figure 5:
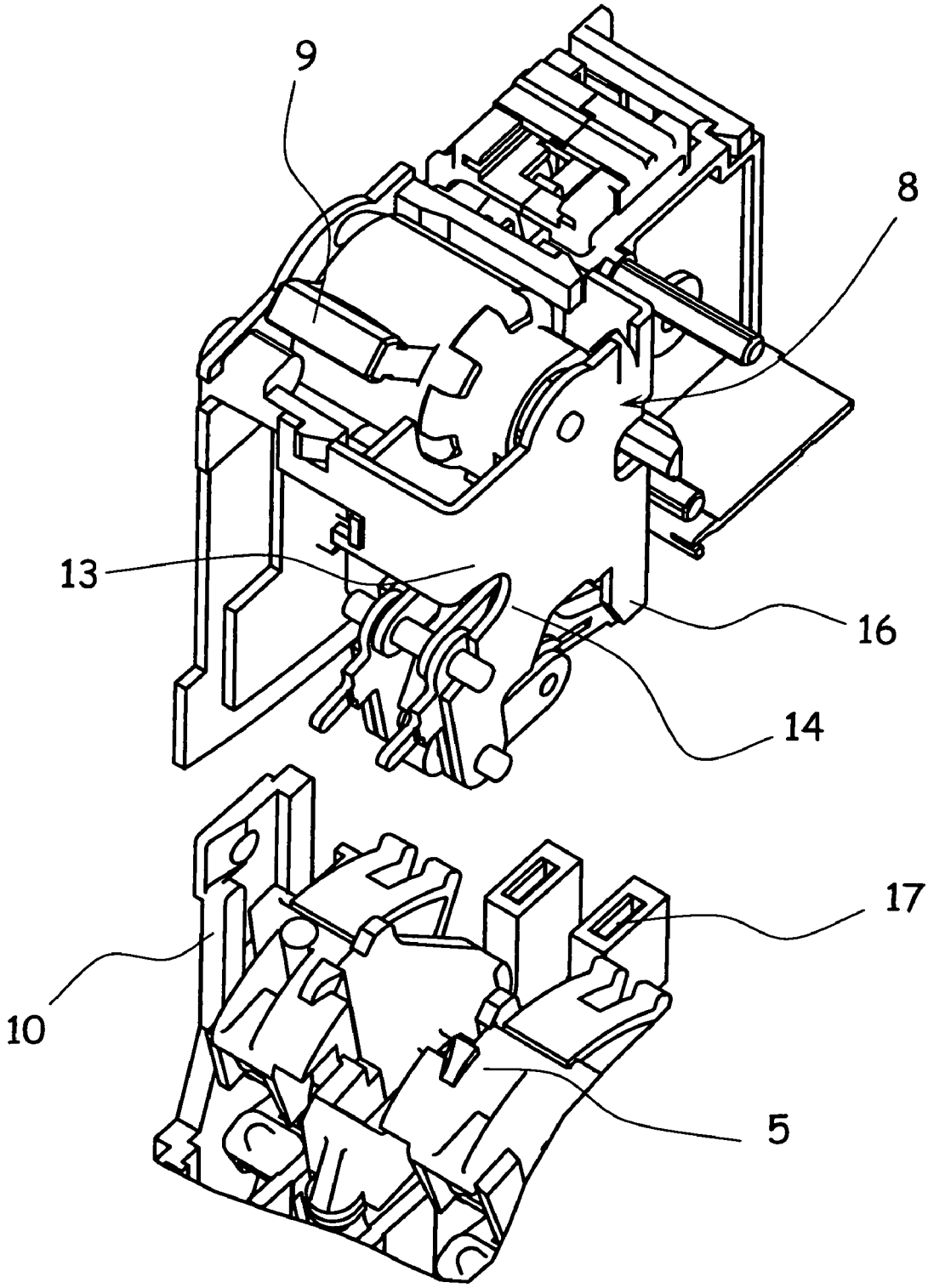
FIG. 5 is a partial perspective view illustrating the mechanism and a part of the unit before the mechanism is fitted on the unit.
Figure 6:
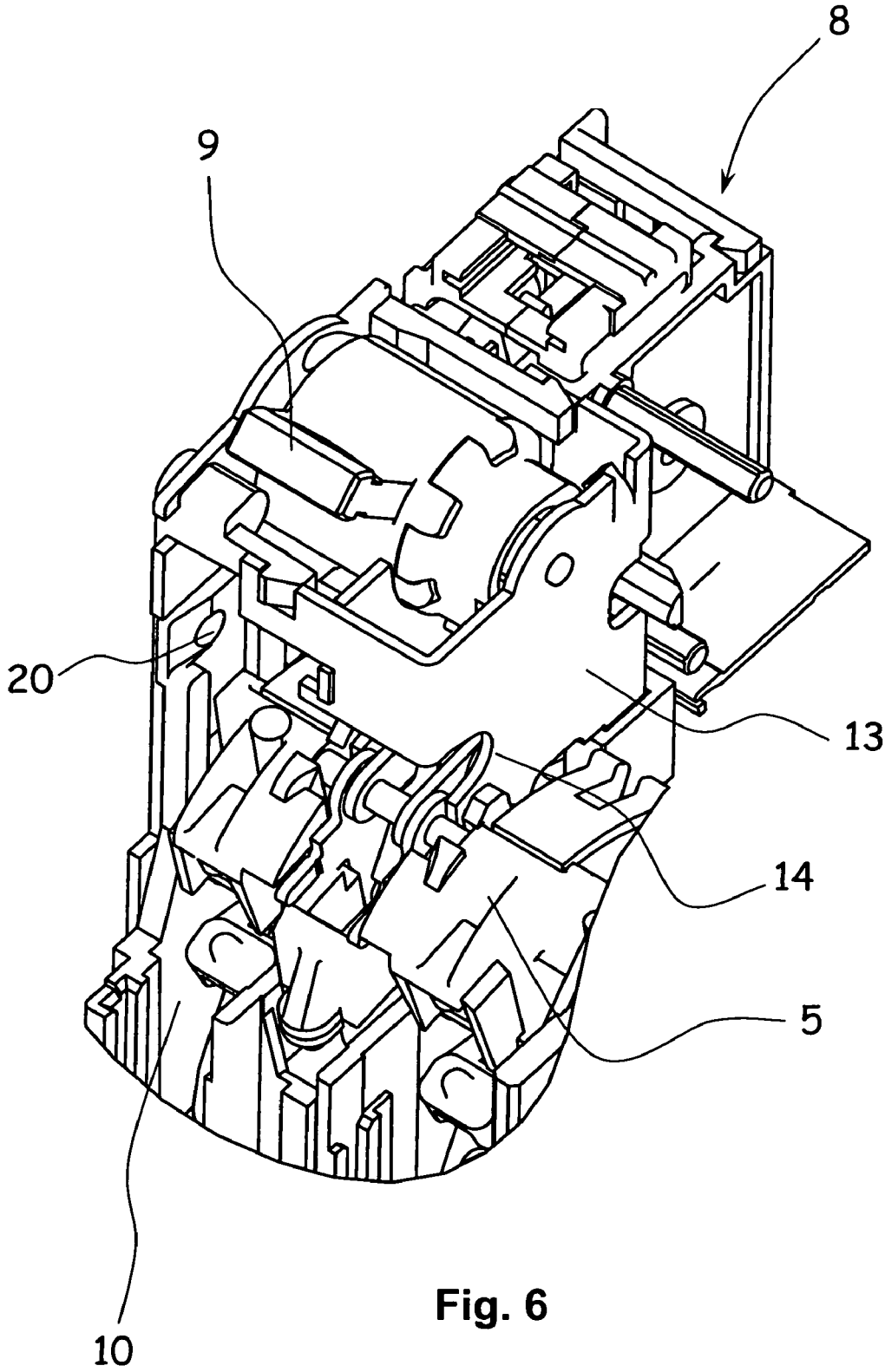
FIG. 6 is a similar view to FIG. 5, after the mechanism has been fitted on the unit.

This high-speed closing shaft is then swiveled until end part 15 of said shaft enters notch 14 made in the mechanism support, as illustrated in FIG. 3, and the opposite end 12*b* of said shaft 12 is then inserted in a second hole 20 provided in the breaking module.

This high-speed closing shaft 12 is mounted rotating with respect to breaking module 10, the above-mentioned spring 18 being fitted between high-speed closing shaft 12 and said module 10 and being designed to bias said shaft 12 in the direction of the contacts.

An electrical switchgear unit of simple design has thereby been achieved by means of the invention, wherein differentiation can be delayed as long possible on the manufacturing line with the high-speed closing function.

It is in fact possible to decide whether to fit the high-speed closing shaft or not just before closing the case.

It is also possible to fit a high-speed closing shaft with a specific stop for the neutral on the right or on the left.

Naturally the invention is not limited to the embodiments described and illustrated which have been given for example purposes only.

On the contrary, the invention extends to encompass all the technical equivalents of the means described as well as combinations thereof.

The invention claimed is:

1. An electrical switchgear unit assembly, said unit being housed in a case, and comprising:

at least one stationary contact and at least one movable contact, the at least one movable contact supported by a rotatable contact support shaft for rotating the at least one movable contact to an open or closed position, the open position defined by a separation between the at least one movable contact and the at least one stationary contact, and the closed position defined by contact between the at least one movable contact and the at least one stationary contact, an opening and/or closing mechanism of the at least one movable contact fitted in a support, said mechanism comprising a manual operating handle rotatably fitted around a toggle pin of the case, a high-speed closing shaft for maintaining the at least one movable contact in the open position, at the beginning of a manual closing operation of the handle, during a period of initial movement of the handle, by storing energy, and releasing the at least one movable contact after the initial movement of the handle so that the stored energy causes high-speed closing of the at least one movable contact to the closed position, and means for fixing the mechanism inside the case, wherein the support of the mechanism is monoblock and comprises, on one of its side faces, an opening for accommodating at least a part of said high-speed closing shaft, the high-speed closing shaft at least partially laterally insertable into said support when the support is fitted inside the case, the direction of insertion of the shaft into the support being substantially perpendicular to the longitudinal axis of the shaft wherein said means is located on one side of the mechanism only with respect to the high-speed closing shaft.

2. The electrical switchgear unit assembly according to claim 1, further comprising a breaking module comprising at least one arc chute, the mechanism being fixed onto said breaking module.

3. The electrical switchgear unit assembly according to claim 1, further comprising a breaking module comprising at least one arc chute, said high-speed closing shaft being rotatably mounted with respect to said breaking module.

4. The electrical switchgear unit assembly according to claim 3, wherein the breaking module is a removable monoblock module.

5. The electrical switchgear unit assembly according to claim 2, wherein the means for fixing the mechanism onto said breaking module comprises a clipping or clipsing means.

6. The electrical switchgear unit assembly according to claim 5, wherein the means for fixing the mechanism onto the breaking module comprises at least one lug of the support of the mechanism slidably secured to at least one slide of the breaking module.

7. The electrical switchgear unit assembly according to claim 6, comprising a spring for biasing the high-speed closing shaft in the direction of the at least one movable contact, said spring fitted between said breaking module and the high-speed closing shaft.

8. The electrical switchgear unit assembly according to claim 1, wherein the unit is selected from the group consisting of a switch, a controlled switch, a disconnecting switch, a circuit breaker, a differential switch and a differential circuit breaker.

* * * * *